US009993118B2

(12) United States Patent
Braxton

(10) Patent No.: US 9,993,118 B2
(45) Date of Patent: Jun. 12, 2018

(54) RELOCATABLE DECONTAMINATION STATION AND LAVATORY

(71) Applicant: Pharmaceuticals.Org, Inc., Utica, MI (US)

(72) Inventor: Earl Jacob Braxton, Utica, MI (US)

(73) Assignee: Pharmaceuticals.Org, Inc., Utica, MI (US)

( * ) Notice: Subject to any disclaimer, the term of this patent is extended or adjusted under 35 U.S.C. 154(b) by 0 days. days.

(21) Appl. No.: 15/357,728

(22) Filed: Nov. 21, 2016

(65) Prior Publication Data

US 2017/0143169 A1 May 25, 2017

Related U.S. Application Data

(60) Provisional application No. 62/257,324, filed on Nov. 19, 2015.

(51) Int. Cl.
*A47K 4/00* (2006.01)
*E03C 1/01* (2006.01)
(Continued)

(52) U.S. Cl.
CPC ..... *A47K 4/00* (2013.01); *E04B 1/34336* (2013.01); *E04H 1/1277* (2013.01)

(58) Field of Classification Search
CPC ..... A47K 4/00; E04B 1/34336; E04H 1/1277; E04H 1/1216
(Continued)

(56) References Cited

U.S. PATENT DOCUMENTS 1,580,661 A * 4/1926 Funk ..... A47K 4/00 108/38
2,037,895 A * 4/1936 Gugler ..... E04B 1/34869 137/357
(Continued)

*Primary Examiner* — Benjamin R Shaw
(74) *Attorney, Agent, or Firm* — Cargill & Associates, PLLC; Lynn E. Cargill

(57) ABSTRACT

A relocatable, easily movable worksite sanitation system that is a combination decontamination station and lavatory with two separate rooms suitable for complying with ADA and safety regulations that is continuously automatically electrically checked and verified to be in proper working order. The sanitation system has a water source and a power source, and the sanitation system includes an improved flush-type lavatory comprising at least a toilet and a sink with a lavatory water supply line providing water to said toilet and said sink. Both the lavatory and the decontamination rooms include an electrical system with a switch for turning the electrical system on and off. The decontamination station has at least an eye wash station and a shower with a decontamination water supply line providing water to said eye wash station and to said shower. The self-checking power system is included in the decontamination station electrical system with a decontamination station switch having an on position, wherein said on position provides power to said decontamination station electrical system. Further, a valve is adapted to receive water from said water source that actuates the decontamination station switch between providing water to said lavatory water supply line and said decontamination water supply line. The valve provides water to the decontamination water supply line when the decontamination station switch is in its "on" position.

5 Claims, 11 Drawing Sheets

(51) Int. Cl.
*E04B 1/343* (2006.01)
*E04H 1/12* (2006.01)

(58) Field of Classification Search
USPC ..... 4/663, 597; 137/804
See application file for complete search history.

(56) References Cited

U.S. PATENT DOCUMENTS

| | | | | | |
|---|---|---|---|---|---|
| 2,076,403 | A * | 4/1937 | Geerlings | 4/549 | |
| 2,907,048 | A * | 10/1959 | Gould | E03C 1/01 | 4/597 |
| 4,796,311 | A * | 1/1989 | Shankman | E04H 1/1277 | 128/897 |
| 4,858,256 | A * | 8/1989 | Shankman | B60P 3/005 | 296/19 |
| 5,065,462 | A * | 11/1991 | Romano | A47K 4/00 | 4/604 |
| 5,742,956 | A * | 4/1998 | Tarver | A47K 4/00 | 4/644 |
| 7,882,577 | B2 * | 2/2011 | Merz | B60R 15/00 | 4/663 |
| 2003/0140571 | A1 * | 7/2003 | Muha | A47K 4/00 | 52/79.1 |
| 2004/0010847 | A1 * | 1/2004 | Braxton | A47K 4/00 | 4/664 |
| 2008/0148476 | A1 * | 6/2008 | Lin | A47K 4/00 | 4/663 |

* cited by examiner

RELOCATABLE DECONTAMINATION STATION AND LAVATORY

CROSS-REFERENCE TO RELATED APPLICATIONS

This application claims the benefit under 35 U.S.C. 119(e) of U.S. Provisional Application No. 62/257,324 filed on Nov. 19, 2015.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS WEB)

Not Applicable

STATEMENT REGARDING PRIOR DISCLOSURES BY THE INVENTOR OR A JOINT INVENTOR

Not Applicable

BACKGROUND OF THE INVENTION

Field of the Invention

This present disclosure relates to a relocatable decontamination station and lavatory. Decontamination stations are common on remote location events and worksites, such as where hazardous materials are used or where conditions are such that worksite injuries are foreseeable or reasonably expected. A common decontamination station is defined by objects and systems which can provide aid to an event attendee or a remotely located or stationary worker who has been injured or has otherwise been adversely affected at a worksite. The decontamination station may include, but is not limited to, a shower, an eyewash station, a first aid kit, a stretcher, or other objects as necessary. Decontamination stations are more common in buildings having worksites where hazardous conditions are known.

Decontamination stations can be critical to worksite safety. For instance, if a worker is contacted with a chemical, the severity of the damage caused by the chemical is often time-dependent, meaning the quicker the chemical is washed off, the lesser the injury to the worker. For some worksites it may be difficult or impossible to position a built-in decontamination station in close proximity to the workers.

Decontamination stations are infrequently used at a given worksite since worksite accidents are relatively rare. It is important that the decontamination station be in proper working order at the time of an accident. Current decontamination stations must be regularly checked and verified to be in proper working order by a technician. Such verification can be time consuming and costly. Having a portable decontamination station which automatically verifies proper function is desired.

A lavatory, or bathroom, is a room or compartment which generally contains a toilet and a sink, among other amenities. Lavatories may be stationary, such as a room built as part of a home or building, or they may be portable, such as are known in the art. Portable lavatories typically include a tank or box having an opening at the top which includes a toilet seat, whereby any human waste is collected in the box below the user. Such human waste is often visible to the user through the toilet seat and emits odors. Such systems usually use chemicals to treat and deodorize the human waste, but such treatment of the waste is often insufficient as compared to the conditions of a built-in lavatory. As such, typical tank-type portable lavatories are typically unappealing to users due to the odor and visible waste. Improved portable lavatories are known which utilize a flush-type toilet which moves the waste to either a storage tank or to a wastewater treatment facility (such as a septic field or municipal waste treatment facility).

Often, worksites are not permanently located at a fixed location, but are rather remotely located. For example, the location where workers are working on a worksite may move during the course of a construction project. In such a case, a stationary decontamination station or lavatory will be insufficient since it will be impossible for a stationary site to remain in close vicinity to the workers as the workers move with the construction project.

An improved relocatable lavatory and decontamination station is desired for such instances. In certain instances, a ground level lavatory and/or decontamination station may be necessary to comply with ADA requirements. Such a sanitation system would be most desirable if it were inexpensive, movable and ADA compliant.

SUMMARY OF THE INVENTION

The present disclosure describes a novel and non-obvious portable sanitation system including at least a toilet and an emergency station which can be bolted, or otherwise fastened, onto a work or entertainment trailer which makes the trailer into a fully functioning, health and safety amenable space. My portable sanitation system can either be placed at ground level or at trailer height depending on which level accommodates the most common usage of the sanitation system. Especially when the portable sanitation system is at the ground level, such a mobile lavatory and decontamination station can now become an ADA compliant unit that provides a completely outfitted sanitation trailer. Alternatively, the portable sanitation system can include a ramp or steps that step up to a raised portable sanitation system level whose floor is level with a trailer so that workers or occupants of the trailer can use the sanitation system without going up or down steps.

The disclosed portable sanitation system may include a ground level lavatory and/or a decontamination station, either combined into one room or separated into two rooms. A desirable sanitation system in accordance with a first aspect of the present invention will be a movable shelter that may include at least two adjacent rooms with a lavatory and a separate decontamination station so that a person in the lavatory has privacy while someone using the decontamination station can have unobstructed access and unfettered use in an emergency. Generally, anyone using the decontamination station will not require as much privacy as one using the lavatory. As one can imagine, someone requiring immediate decontamination in an emergency, would not want to wait for someone to get out of the lavatory. Rather, they would want immediate unobstructed access to a separate room with the available decontamination equipment.

The sanitation system described herein provides many benefits as compared to the prior art. The present sanitation system is portable, complete, private, can be ADA compliant, provides unobstructed access and is attractive, meaning that it can be moved to any desired location, whether indoors or outdoors. The present sanitation system provides unobstructed access to sanitation facilities, important in many settings. Factory settings would be ideal for a movable portable sanitation system in order to provide sanitation in varying locations. Since the sanitation system of the present invention can be moved around within the factory or workshop setting to accommodate the location of the workers, time can be saved for workers having to leave their locations in order to use the facilities. As time is money in a factory, such a sanitation system would be most desirable.

In one preferred aspect, the present sanitation system may utilize a flushable toilet that allows the waste to flow waste straight back without needing any excavation. This type of toilet can be used in the same way as a standard toilet, reducing or eliminating the odors associated with a standard portable toilet and completely eliminating viewing the waste after flushing. Also envisioned is the inclusion of perhaps a waterless urinal, either alone or in combination with a toilet, no matter if other amenities are present.

The present sanitation system integrates the plumbing of the lavatory with the plumbing of the decontamination station in such a way that use of either the toilet or the sink in the lavatory proves that the plumbing in the decontamination system is working. The present sanitation system integrates the electrical system in the lavatory with the electrical system in the decontamination station such that use of any of the electrical devices in the lavatory, such as the lights, confirms the proper working order of the electrical systems in the decontamination station. As such, each use of the lavatory provides evidence that both the plumbing and electrical systems in the decontamination station are functioning properly.

The portable sanitation system described herein is a portable shelter having surrounding walls, a floor and a ceiling. The walls preferably separate the lavatory and the decontamination station into separate rooms such that both can be used simultaneously while providing privacy in each of the lavatory and decontamination stations. In one aspect, the portable sanitation system includes a single lavatory; in another aspect, the portable sanitation system includes two or more lavatories. The portable sanitation system receives water from an external source, such as a water tank or a municipal water source, possibly by a hose or the like.

The portable sanitation system may receive electricity from any source, including external sources, such as a generator or any other suitable electricity source or even a battery power backup system. The lavatory includes a door which is closable for privacy. The decontamination station includes an opening that allows access, such as either a full panel door, or it may be merely hanging plastic strips or curtains. Because privacy levels in the decontamination station would generally be less than the level needed within the lavatory, any visual shield would do the job. A contaminated person may need to remove their clothes to become decontaminated, so a curtain would suffice. The sanitation system includes one or more outgoing pipes which moves waste liquid out of the sanitation system to a waste receptacle, such as to a holding tank or to a municipal sewer system.

The lavatory may include both a toilet and a sink. The toilet is the same as, or similar in appearance and function to, a standard flush toilet found in a typical built-in lavatory, in that after use the toilet is flushed, the waste is removed from the holding tank, or is flushed into the sewer or a septic tank. The sink is the same as, or similar in function to, a standard sink found in a typical built-in lavatory. The sink is plumbed with water to allow a user to wash her hands following use of the toilet. A soap dispenser is located near the sink to aid the user in washing her hands. Optional hand sanitizing station equipment may also be present.

The decontamination station preferably includes at least an eye wash station and a shower. The eye wash station includes one or more water spouts which allow a user to wash and rinse her eyes. The shower allows a user to rinse her body. In one aspect, the decontamination station is plumbed with a water heater which is in fluid communication with both the eye wash station and the shower to provide water thereto at an elevated temperature as compared to the temperature at which the water enters the sanitation system.

The plumbing system in the lavatory receives water from an external source which enters the sanitation system through an inlet pipe. The inlet pipe preferably includes a T-junction, splitting the inlet into a lavatory line and a decontamination line, with the lavatory line directing water to the toilet and the sink and the decontamination line directing water to the decontamination station. The decontamination line may optionally include a filter and a pressure regulator. Such a filter removes particulates from the decontamination line. The pressure regulator regulates the pressure in the decontamination line to bring the pressure in the decontamination line to the pressure needed to supply water to the eye wash station and the decontamination shower.

The plumbing systems for both the lavatory and the decontamination station are plumbed to one or more outlets for removing the spent fluid from the lavatory and the decontamination station. Preferably, the outlets from the lavatory and the decontamination station meet at a series of valves, which valves allow the selective discharge of liquid from either or both of the decontamination station or the lavatory.

BRIEF DESCRIPTION OF THE DRAWINGS

A more complete and full understanding of the aspects and nature of the present invention will become apparent upon considering the following detailed description, when taken in connection with the accompanying drawings, wherein.

DETAILED DESCRIPTION OF THE INVENTION

Therefore, in accordance with the present invention, a portable sanitation system comprising a combination decontamination station and lavatory is disclosed.

Figure 1:
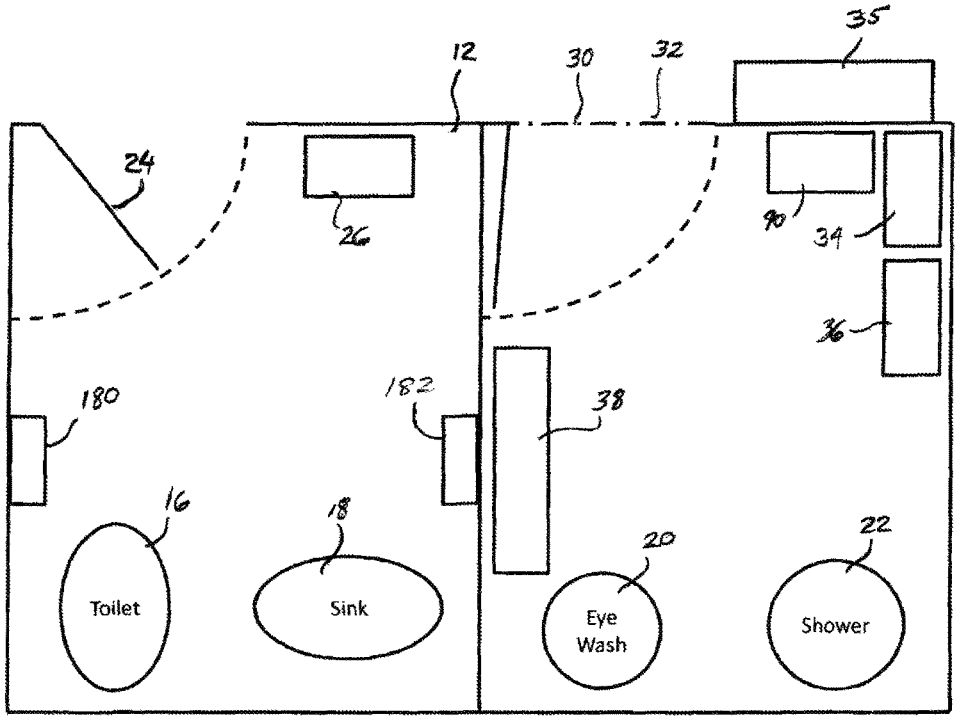
FIG. 1 is a block diagram showing the general layout and configuration of the various aspects of the sanitation system described herein.

Referring to FIG. 1, the present disclosure describes a portable sanitation system 10. As used herein, "portable" means that the system is not integrally built as part of a structure or building. The system may be portable in the sense that the system may be readily moved, such as by a forklift or other lift system as assembled, or alternatively, the system may be readily broken down into pieces which are suitable for being moved to another location where the system can be reassembled. Portable lavatories are well known in the art, such as U.S. Pat. Nos. 4,380,836, 6,721,967 and 4,493,118, each of which are incorporated herein by reference.

The first aspect of the present invention may include a portable sanitation system 10 as shown in FIG. 1 including two principle parts: a lavatory 12 and a decontamination station 14. The lavatory 12 is a room which may house at least a toilet 16 and preferably also a sink 18. Also envisioned is the inclusion of a waterless urinal either in addition to a toilet and a sink, or singly by itself. The decontamination station 14 is a room which is intended to house safety equipment, such as an eye wash station 20 and a shower 22, among others. Together, in this aspect, the lavatory 12 and the decontamination station 14 define the portable sanitation system 10, the component parts of which are described in greater detail below. Further this decontamination room may include a dispenser for disposable bags when the room is used for an emergency exchange of contaminated clothing.

In this and other aspects of the present invention, the lavatory room and the decontamination room may be two individual completely assembled units that can be more easily transported and situated for use. The present invention could alleviate any on-site assembly by being delivered already fully assembled and ready for turn-key operation. Under certain circumstances, in practice, one might find that it takes heavy equipment to move a combination lavatory/decontamination building, possibly heavy equipment that the purchaser does not have on hand. Therefore, as one can imaging, two separate rooms may be easier to ship, move and situate. The decontamination room may be a separate room all together by itself, which can be moved into position next to a lavatory, or it may be moved and located near a location where emergencies are more likely to happen than next to a lavatory.

The lavatory 12 is an enclosed room defined by surrounding walls, a floor and a ceiling. The lavatory 12 includes a door 24 which provides ingress and egress to the lavatory, and provides privacy. The toilet 16 is preferably a standard flush-type toilet, similar to what is available in standard restrooms, although any other type of suitable toilet may be used, including a P-type toilet. In addition, a sink and a waterless urinal may also be included. The toilet 16 is plumbed such that it receives water from an external source and deposits waste to an external receptacle, as described in greater detail below. The sink 18 is plumbed in a similar fashion as the toilet 16 in that it is plumbed to external reservoirs. If a waterless urinal is desired, it can be attached to any of the surrounding walls. The lavatory 12 is built in a way which simulates a standard built-in restroom with running water, but is portable and can easily be moved to another location. The lavatory 12 may also be wired with electricity to provide powered equipment such as a light 26 and a fan 28 (not shown in FIG. 1). The electrical and plumbing systems are described in greater detail below.

The decontamination station 14 is an enclosed room defined by surrounding walls, a floor and a ceiling. The decontamination station 14 includes a doorway 30 which is preferably freely passable by users. In one aspect, the doorway 30 includes plastic strips 32, a curtain, or other freely movable object which will allow a user to enter and exit the decontamination station without using her hands, but also provides some protection from the elements (such as rain, wind, pests, dust and other objects which should be kept out of the decontamination station 14). A door 33 is optionally included to close doorway 30, though during operation, the door 33 is preferably propped open.

The decontamination station 14 may also house other items which may provide aid to a person who uses the station, such as a stretcher 34, a first aid kit 36, or other suitable objects. In one aspect, these other items may be stored in a storage cabinet 35 which is mounted either to the interior or the exterior of the decontamination station 14. The eye wash station 20 and the shower 22 are plumbed to the plumbing system of the lavatory 12, as described in greater detail below. The decontamination station optionally includes a water heater 38 for heating all or a portion of the water which is used in the eye wash station 20 and/or the shower 22. In one aspect, the water heater 38 also supplies hot water to the sink 18. The decontamination station 14 is also wired with electricity to provide powered equipment such as a light 40 and a fan 42 (not shown in FIG. 1). The electrical and plumbing systems are described in greater detail below.

Figure 5:
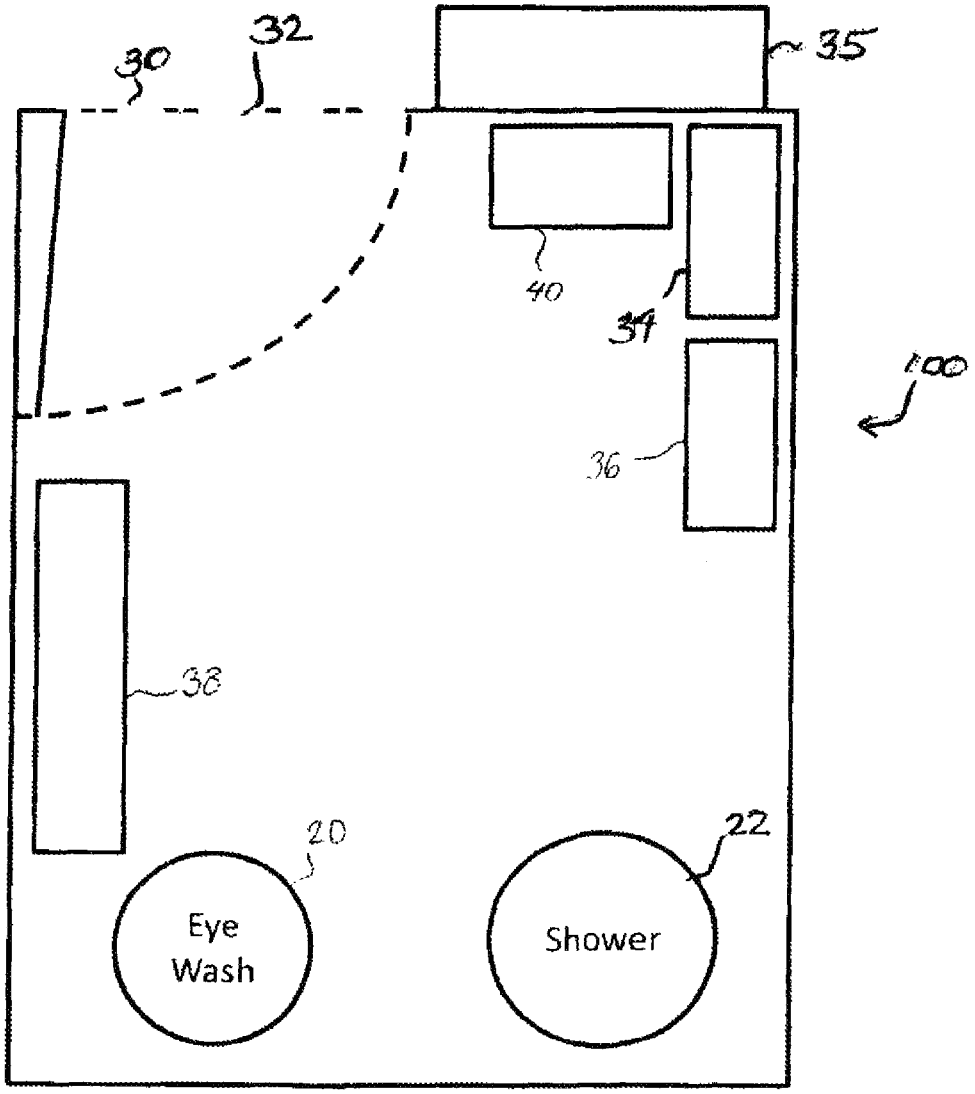
FIG. 5 is a block diagram showing the general layout and configuration of a standalone decontamination station.

FIG. 1 shows the lavatory 12 and the decontamination station 14 as adjacent to one another. The space between the lavatory 12 and the decontamination station 14 shown in FIG. 1 is for illustrative purposes; the lavatory and 12 and the decontamination station 14 may each be free standing, and abut one another, or they may share a wall or a curtain type closure. In one aspect, the lavatory 12 and the decontamination station 14 are built as a single unit, in an alternative aspect the lavatory 12 and the decontamination station 14 are separable during transport. In an additional aspect the sanitation system 10 is defined by a single lavatory 12 and a single decontamination station 14. In a further aspect, the sanitation system 10 is defined by a plurality of lavatories 12 and a single decontamination station 14. In yet an additional aspect, as shown in FIG. 5, the decontamination station is a stand-alone unit.

Figure 2:
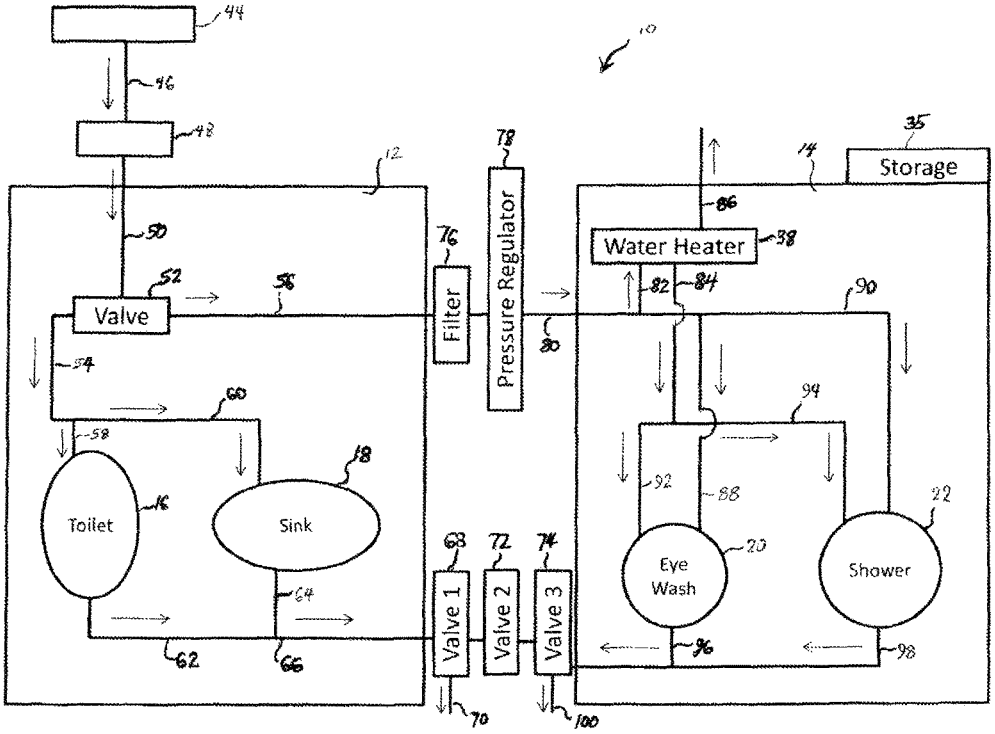
FIG. 2 is a block diagram of the sanitation system of FIG. 1 and including the general layout of the plumbing system, here water is provided to the sanitation system by a connected water tank.

Referring now to FIG. 2, this Figure provides a block diagram showing the general layout of the elements of the lavatory 12 and the decontamination station 14. Specifically, FIG. 2 illustrates the layout of the plumbing system of the sanitation system 10. The flow of water in the sanitation system 10 is indicated by the arrows and starts at the water source 44, which may be any source of water, whether it is supplied by a water hose, like a garden hose, or it may be a portable water tank which can serve as the source for water into the sanitation system 10. If a waterless urinal is utilized, appropriate water hook-ups will be implemented. In the event that a water tank 44 it utilized, there is disclosed an optional pump for bringing water from water tank 44 including an outlet which is joined to a pipe 46 which in turn is joined to optional pump 48. The pump 48 moves the water from the tank 44 to the sanitation system 10. The pump 48 also adds pressure or "head" to the water sufficient to allow the toilet 16 and the sink 18 to have sufficient water pressure to function properly. If the water source is a continuous supply water hose, there would be sufficient water pressure to function properly without the optional pump 48.

In either aspect of the above mentioned configuration, the water leaving water source 44 would then travel through a pipe 50 to a valve 52. The valve 52 serves to divert the water from the water source 44 to either the lavatory 12 or the decontamination station 14. The valve 52 is a switch valve that is preferably electronically controlled, switching the path of the water between a lavatory line 54 and a decontamination line 56. The lavatory line 54 splits into a toilet supply line 58 and a sink supply line 60, which provides water to the toilet 16 and the sink 18 respectively. As described in greater detail below, valve 52 is integrated with the electrical system in the decontamination station 14, such that use of the decontamination station 14 automatically causes valve 52 to divert the flow of water to the decontamination station 14. The toilet 16 may be either direct path flush toilet, not requiring any excavation, or a standard flush-type toilet, whereby the water and waste together are evacuated from the toilet through a toilet evacuation line 62. The sink 18 includes a drain through which water is evacuated from the sink to a sink evacuation line 64. The sink evacuation line 64 connects via a junction 66 to the toilet evacuation line 62. The toilet evacuation line 62 terminates in a first valve 68. The first valve 68 is a standard switch valve which can be actuated to divert flow to either a first outlet line 70 or to a second valve 72. The second valve 72 can be actuated to either allow fluid communication between the first valve 68 and a third valve 74, or can be closed to stop fluid from traveling between the first valve 68 and the third valve 74. The third valve 74 is discussed below in greater detail in context of the decontamination station 14.

Still referring to FIG. 2, the decontamination line 56 may include a filter 76 and a pressure regulator 78. The filter 76 and the pressure regulator 78 would be positioned in the decontamination line 56 after valve 52 and before either the eye wash station 20 or the shower 22. The filter 76 serves to filter the water passing through the decontamination line 56, and can serve to remove particulates or other unwanted matter from the decontamination line 56. The pressure regulator 78 serves to regulate the pressure in the decontamination line 56. The pressure regulator 78 preferably serves to keep the flow in the decontamination line 56 at or below a desired pressure. Preferably, the filter 76 is located before the pressure regulator 78. As used herein, "before" means upstream, or that the water will pass through the filter 76 before the pressure regulator 78. As used herein, "after" means downstream, or that the water will pass through the pressure regulator 78 after the filter 76. The drawings include arrows representing the fluid flow direction under normal operating conditions. In another aspect, the pressure regulator 78 is positioned before the filter 76. The valve 52 governs whether water passes through the lavatory line 54 or the decontamination line 56.

Still referring to FIG. 2, the water exits the pressure regulator 78 to a decontamination station supply line 80. A water heater supply line 82 branches from the decontamination supply line 80, and diverts a portion of the water therein to the water heater 38 which elevates the temperature of the water. The water heater 38 includes a water inlet which receives water from the water heater supply line 80 and a hot water outlet which provides water to a water heater outlet line 84. The water heater 38 optionally includes a secondary outlet which provides water to a water heater drain line 86 for the purpose of draining the water heater 38. The water in the decontamination supply line 80 is cold relative to the water in the water heater outlet line 84. The decontamination supply line splits into an eye wash cold supply line 88 and a shower cold supply line 90. The water heater outlet line 84 splits into an eye wash hot supply line 92 and a shower hot supply line 94. The eye wash station is plumbed to receive cold water from the cold supply line 88 and hot water from the hot supply line 92, whereby the incoming water is mixed to a preferably warm and comfortable temperature. Similarly, the shower station is plumbed to receive cold water from the cold supply line 90 and water from the hot supply line 94, whereby the incoming water is mixed to a preferably warm and comfortable temperature.

The eye wash station 20 includes an outlet which allows water to drain from the eye wash station to an eye wash outlet line 96. The shower 22 includes an outlet which allows water to drain from the shower 22 to a shower outlet line 98. The eye wash outlet line 96 is joined by a junction to the shower outlet 98, and the shower outlet line 98 terminates at the third valve 74. The third valve 74 is a standard switch valve which can be actuated to divert flow to either a second outlet line 100 or to the second valve 72. The second valve 72 can be actuated to either allow fluid communication between the first valve 68 and a third valve 74, or can be closed to stop fluid from traveling between the first valve 68 and the second valve 74. The combination of the first valve 68, the second valve 72 and the third valve 74 allow the lavatory 12 and the decontamination station 14 to be drained to different places. The selective draining has the advantage of segregating the human waste from the lavatory 12 from the chemical or other waste from the decontamination station 14, since each has different processing and handling requirements. The valves 68, 72 and 74 also allow drainage of both the lavatory 12 and the decontamination station 14 to the same outlet. The valves 68, 72 and 74 allow for flexible and variable draining options for the lavatory 12 and the decontamination station 14.

In an alternative aspect, the optional water heater outlet line 84 includes a branch which provides heated water to the sink 18 in the lavatory 12 to allow for hot water for hand washing (not shown).

Figure 3:
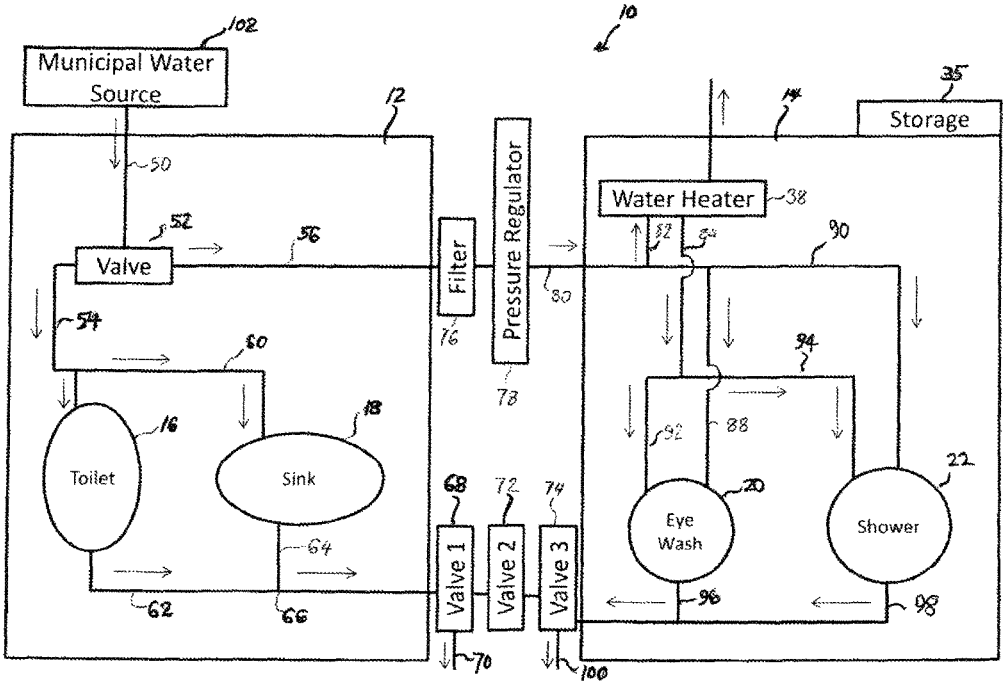
FIG. 3 is a block diagram of the sanitation system of FIG. 1 and including the general layout of the plumbing system, here water is provided to the sanitation system by a municipal water source.

Referring now to FIG. 3, rather than having a source of water from a nearby water tank, this aspect of the present invention shows the plumbing layout of a sanitation system 10 which is fed water from a municipal water source 102. All components which are in common with corresponding components shown in the other Figures are identified by the same reference numerals. It is assumed that water provided from the municipal water source 102 is delivered to the sanitation system 10 at sufficient pressure to operate the toilet 16 and the sink 18, and as such a pump is not required as is needed when a water tank is used to supply the water. The municipal water source provides water to a pipe 50, which serves as the water inlet for the sanitation system 10. All components of the sanitation system 10 shown downstream of the pipe 50 are the same as, or similar to, the components shown in FIG. 2.

Figure 4:
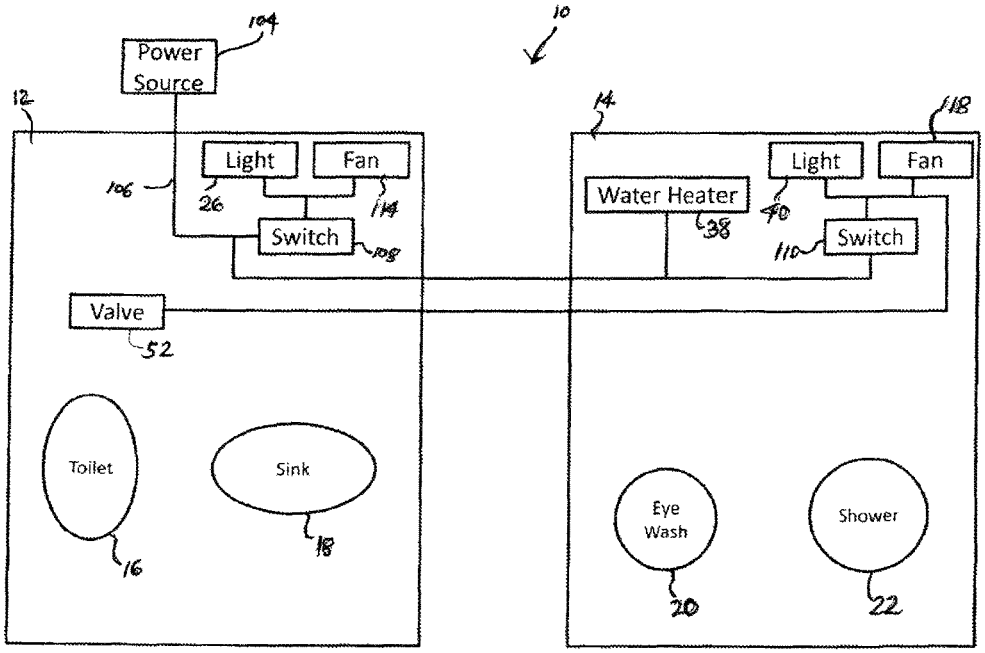
FIG. 4 is a block diagram of the sanitation system of FIG. 1 and including the general layout of the electrical system.

Referring next to FIG. 4, this Figure provides a schematic diagram of an electrical system of sanitation system 10. Again, all components which are in common with corresponding components shown in the other Figures are identified by the same reference numerals. A power source 104 provides electricity to the sanitation system 10. The power source 104 is any suitable power source for providing electricity, such as a municipal power system, a battery system, a solar system, a generator, or any other system suitable for providing the required electricity.

The systems shown in FIG. 4 are not meant to be detailed wiring diagrams, but instead are designed to show basic electrical layouts of the corresponding systems. Power source 104 supplies electricity to the sanitation system 10 via a conduit 106. The conduit 106 is connected to a lavatory switch 108 and a decontamination room switch 110. The lavatory switch may be connected to various components, including light 26 and a fan 114 or an electrical outlet usable for any electrical device to be plugged into, whereby actuation of the lavatory switch 108 turns the light 26 or the fan 114 on or off. All of the electrical systems which are connected to the lavatory switch 108, including the light 26, the fan 114, and any other objects which are suitable, are collectively referred to as the lavatory electrical system. Alternatively, light 26 and the fan 114 may be connected to separate switches. Since both switch 108 and switch 110 are connected to the same conduit, each time the switch 108 is turned on and the fan 114 and the light 26 indicate they are powered, the user knows that power is present, and that power is being provided to both the lavatory 12 and to the decontamination station 14.

For safety's sake, this is an important feature because use of either the light 26 or the fan 114 in the lavatory 12 indicates to the user that the decontamination station is properly powered, eliminating the need for periodic inspections of the electrical system in the decontamination station 14. This self-check function of the electrical system is analogous to the plumbing system—any use of the toilet 16 or the sink 18 provides notice that the plumbing in the decontamination station 14 is properly functioning and ready for an emergency.

The last thing anyone wants is to be involved in an emergency, only to find that the decontamination station is not operable. It is most desirable to have a system for constant monitoring of emergency readiness for the decontamination station. The present invention provides such a monitoring system that is new, useful and non-obvious. Heretofore, the present inventor is not aware of any such emergency ready system.

Still referring to FIG. 4, constant monitoring of emergency readiness for the decontamination station is enabled when decontamination switch 110 is connected to light 40 and fan 118, whereby actuation of the switch 110 turns the light 40 and the fan 118 on or off. All of the electrical systems which are connected to the decontamination station switch 110, including the light 40, the fan 118, and any other objects which are suitable, are collectively referred to as the decontamination station electrical system. Switch 110 is also connected to valve 52, such that actuation of switch 110 also switches on the valve 52, such that when the switch 110 is in the on position, the valve 52 directs water to the decontamination line 56, and when the switch 110 is in the off position, the valve 52 directs water to the lavatory line 54. Thereby, actuating the switch 110 to the "on" position turns on the light 40 and the fan 118, and switches the valve 52 to supply water to the decontamination station 14. This effectively checks the electrical system for emergency readiness. The switch 110 can be a standard actuating light switch, or can also be activated by sensing motion, sound, light or any other suitable type of sensor known in the art. As such, in one aspect, a suitable sensor senses when a person passes through the door 30, and by so doing, the light 40 and the fan 118 may be turned on, and the valve 52 redirects water to the decontamination station 14. The lines shown connecting the various systems in FIG. 4 are electrical conduits.

Referring now to FIG. 5, a standalone decontamination station 120 is provided. Such a free standing unit may be desirable to provide proper equipment capable of enabling certification for worksite permits for work trailers and the like. Imagine bringing numerous work trailers to a work site, but not being able to work there because local safety regulations require a decontamination station. Therefore, disclosed is a decontamination station 120 that is a free standing structure defined by surrounding walls, a floor and a ceiling. The decontamination station 120 includes components similar to the decontamination station 14 shown in the preceding Figures, namely an eye wash station 20, shower 22, possibly a water heater 38, and other objects and structures, with similar objects having the same reference numerals.

FIG. 5 provides a block diagram of a possible layout of various components of the decontamination station 120. The decontamination station 120 shown in FIG. 5 is not plumbed or wired to an attached lavatory, and as such, may be plumbed directly to a water source or a water tank and/or wired directly to an electrical source. As such, the decontamination station 120 lacks the self-check features of the plumbing and electrical system provided by the attached lavatory in the preceding Figures. Alternatively, the decontamination station 120 may include a battery-powered monitoring system which could remotely monitor the electrical and water supply to the decontamination station 120, possibly sounding an alert, or providing a visual display when there is an interruption in water or electricity to the decontamination station 120.

Figure 6:
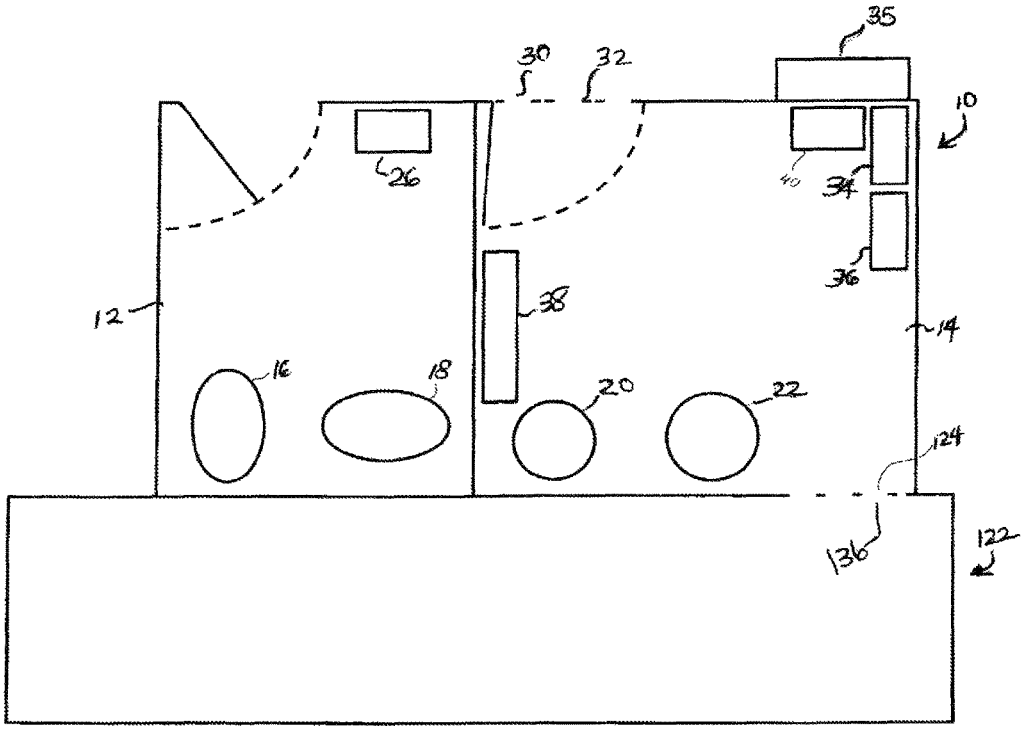
FIG. 6 is a block diagram showing the general layout and configuration of a sanitation system used in combination with a portable work building.
Figure 7:
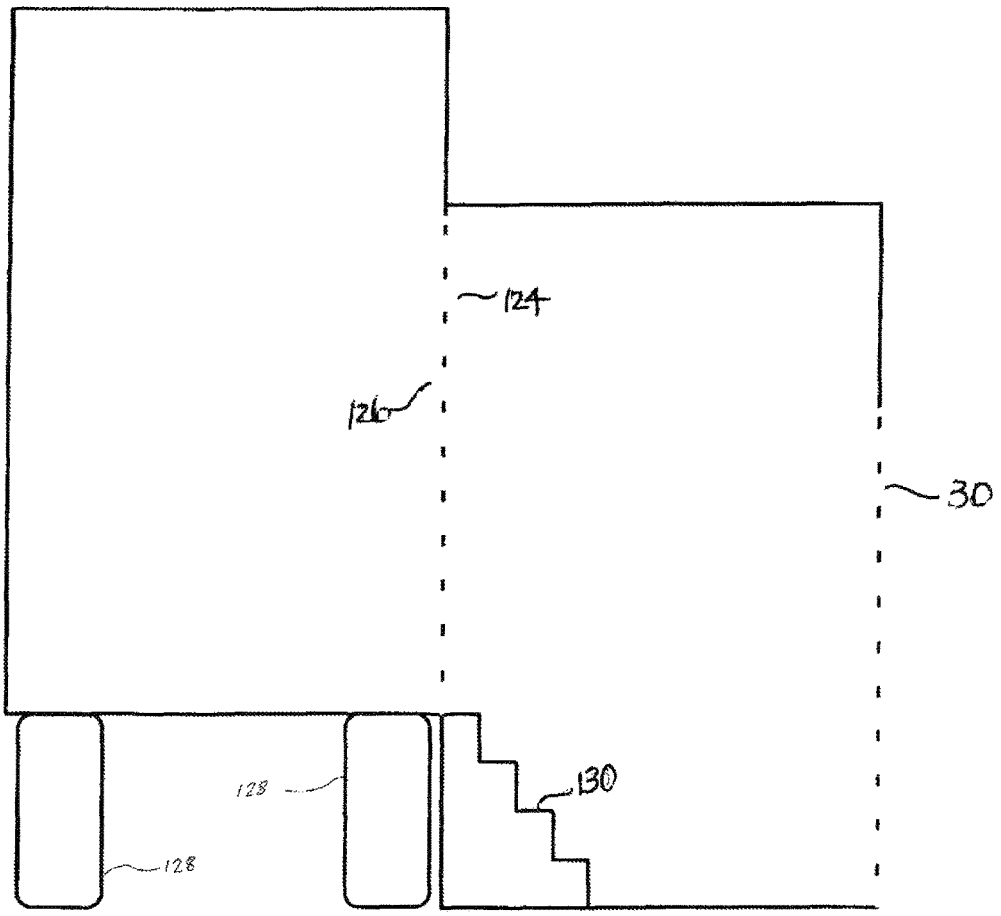
FIG. 7 is a block diagram showing the sanitation system and portable work building combination of FIG. 6 as viewed from the side.
Figure 8:
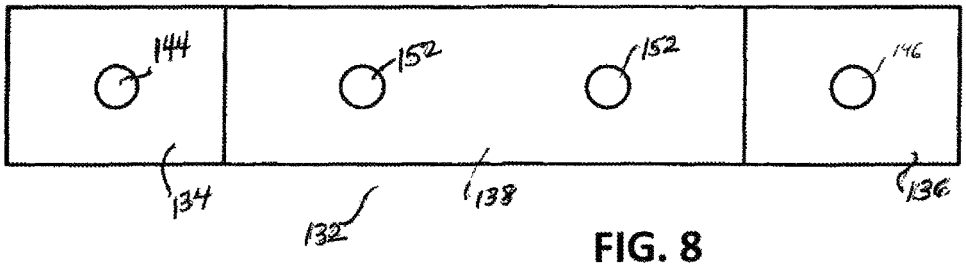
FIG. 8 is a front view of a bracket used to attach an object, such as a hand soap dispenser or a toilet paper dispenser, to one of the walls of the sanitation system.
Figure 9:
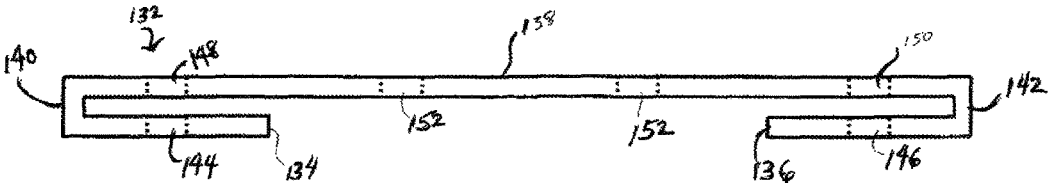
FIG. 9 is a top view of the bracket of FIG. 8.
Figure 10:
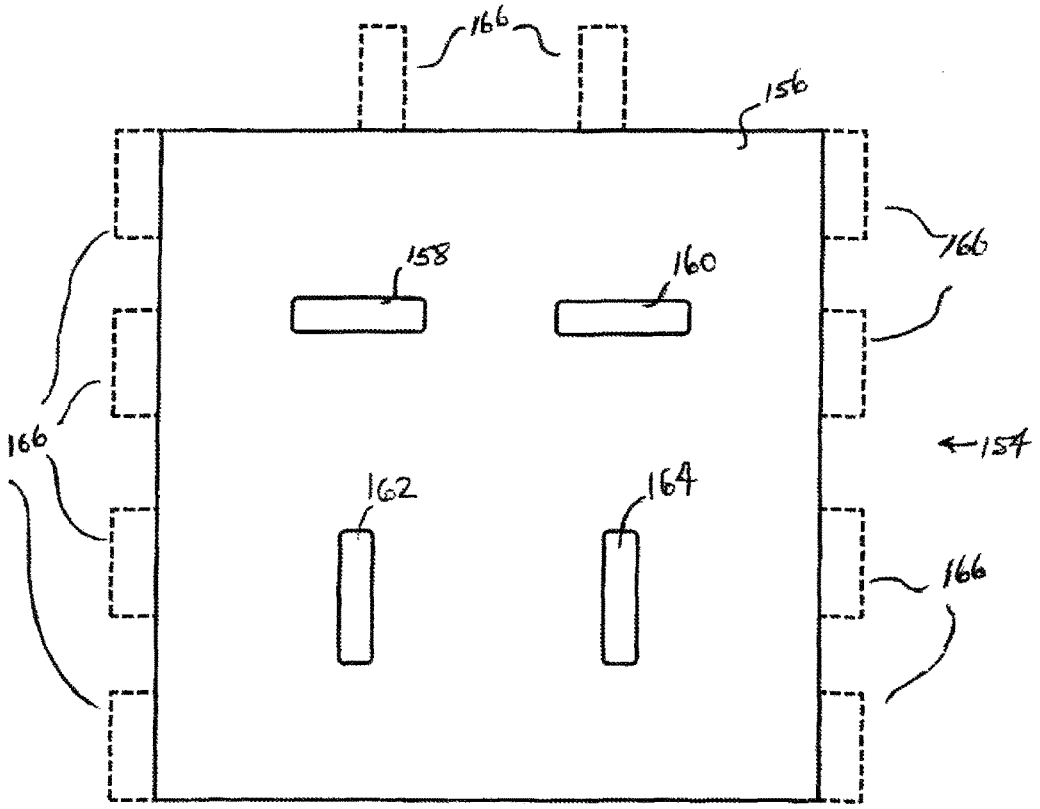
FIG. 10 is a front view of a mating bracket which is suitable for use in combination with the bracket of FIG. 8.
Figure 11:
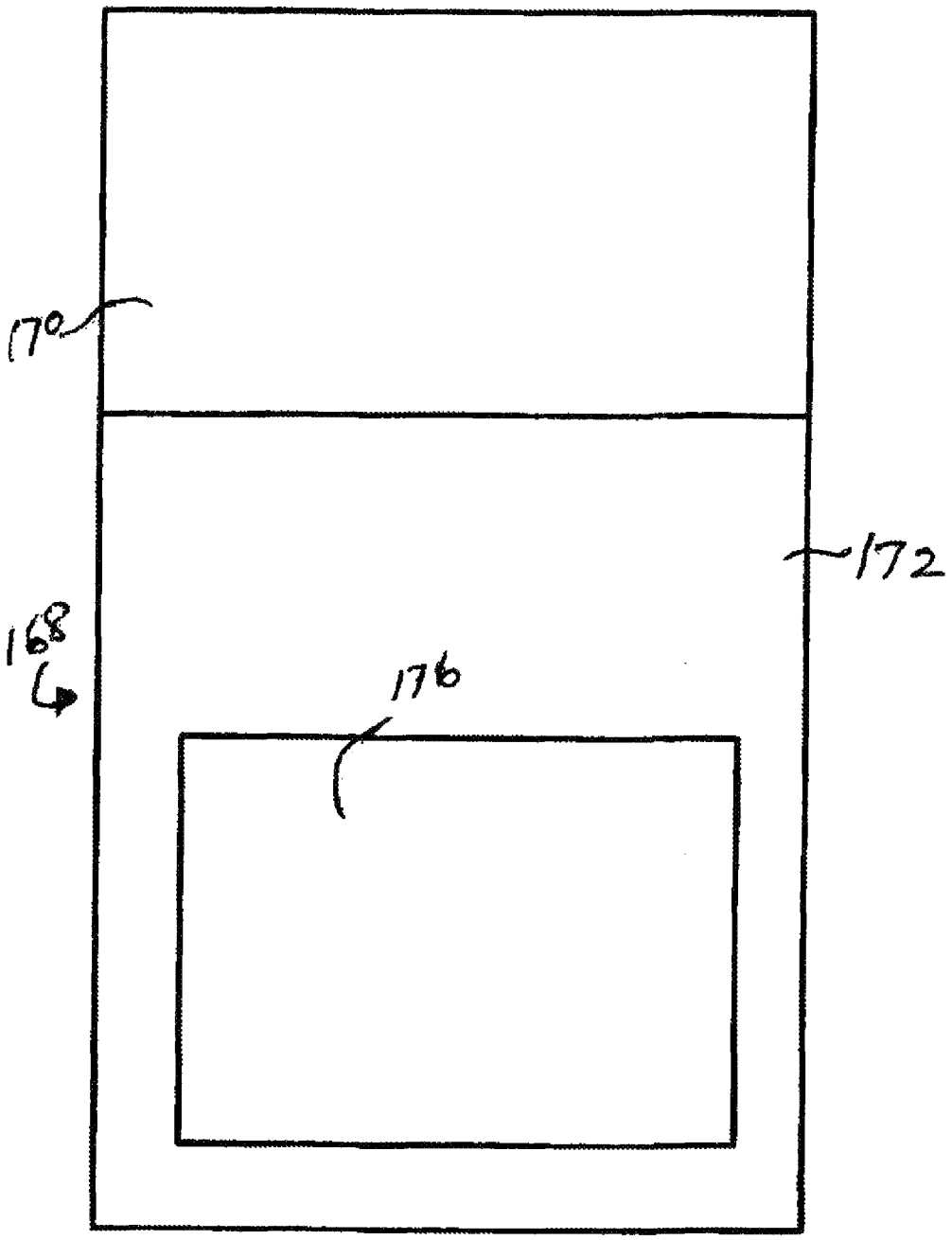
FIG. 11 is a front view of a hanging bracket which is suitable for use in combination with the bracket of FIG. 8.
Figure 12:
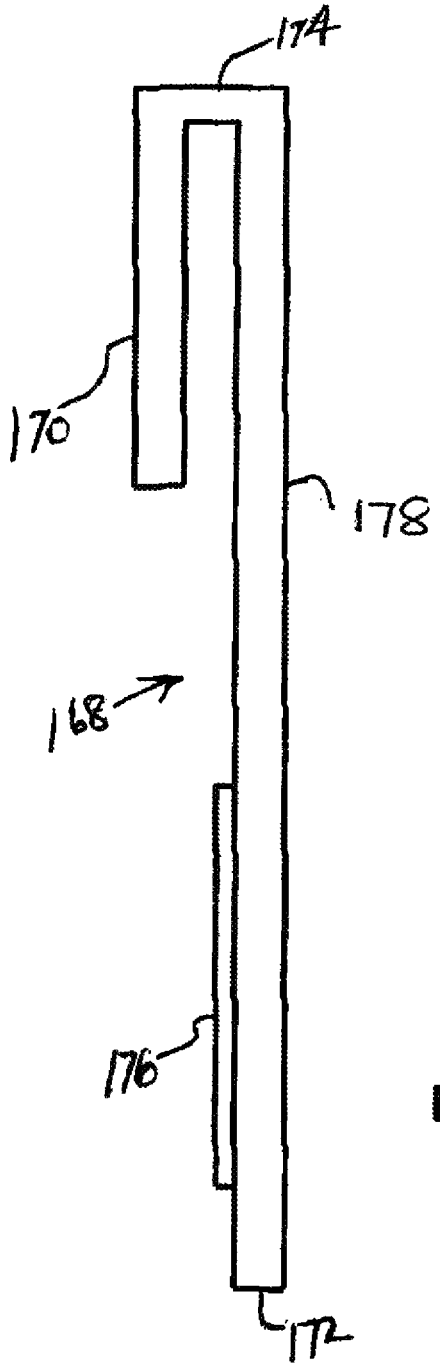
FIG. 12 is a side view of the hanging bracket of FIG. 11.

Referring next to FIGS. 6 and 7, in one aspect, sanitation system 10 may be coupled to a building 122. The building 122 may be a portable office structure, as is common at jobsites, but may also be any permanent or movable structure in need of either a lavatory and/or a decontamination station. The sanitation system 10 is assembled adjacent to building 122, and is removably secured thereto. In one aspect, the decontamination station 120 includes a rear opening 124 which aligns with an opening 126 or door on the building 122, to allow access to the decontamination station 14 from the building 122 without having to battle the outer elements. As shown in FIG. 7, the building 122 may be offset vertically from the sanitation system 10, such as is commonly the case with mobile office buildings which are carried on wheels 128. This vertical offset can accommodate travel between the building 122 and the sanitation system 10, as stairs 130 are provided therebetween. In one aspect, the decontamination station 14 is elongated as compared to the previous aspects to allow room for the door between the decontamination station 14 and the building 122. In another aspect (not shown) a door is present between the building 122 and the lavatory 12. In a still further aspect (not shown) a standalone decontamination station, such as shown in FIG. 5, is attached to the building 122, in such aspect, the aspect of FIG. 5 is modified to include a rear opening to allow access to the building 122.

This aspect sanitation system may be classified as a bolt-on bathroom suitable for health, safety and/or ADA shelters which can be manufactured as a single large module incorporating both the lavatory and the decontamination modules, or it may be manufactured as separate modules by function. The sanitation system module can be large enough to be both a health and safety shelter and an ADA Compliant Lavatory. In accordance with the present invention, the modules may be bolted onto or otherwise attached to a multi-purpose trailer or container that is used on construction, industrial, residential or event sites.

The above described multi-purpose trailer or container may have an access or egress door from inside the trailer that is accessible to the ground level module, making it ADA compliant as well as being accessible from within the trailer without people having to climb down stairs outside to get into the lavatory. If the door of the trailer or container is higher than that of the module, the ground level module's attachment door will be placed at the same level as the trailer or container door and fastened by bolts, rivets or other methods. Interior module steps with safety railings will be added for access into the module from the trailer if the trailer is higher.

The sanitation system module of this aspect of the present invention may also have a street access door. If someone enters the module from the street access door and turns on the light, the access/egress door could lock and will unlock when the street access door is opened and the light is turned off. The remote locking and unlocking of both doors could be achieved by use of magnetic locks. Either or both doors can be fitted with a magnetic lock which could be activated by the light switch at the same time the lights are activated. The same will be true of the access/egress door. If someone enters the sanitation system module from the access/egress door from up above the street level, the street access door will lock, etc.

My bolt-on bathroom, health and safety shelter can also be a stand-alone building for inside or outside construction, industrial or commercial sites making it ADA and safety compliant automatically. Furthermore, the modules could also be used as a Lactation Station or an ADA Compliant Lavatory if required. All doors can be fitted with materials that will provide unobstructed access that can be closed and locked during off hours. Regardless, during working hours, it is preferred that the door should be left open for unobstructed access to personnel having an emergency situation. As time is short for tending to emergencies, an open door will save a few seconds for access to the decontamination system.

The modules may be made of plastic, aluminum, or any other suitable material. They will preferably have a steel frame floor with tine ports for mobility and can be moved and relocated with most material handling equipment.

Consequently, as the present inventor envisions the possibility of the lavatory being on the ground level directly, he envisions such that the lavatory can become compliant with regulations of the American Disabilities Act (ADA). Such compliance can provide a huge advantage to an event planner or contractor over having to assemble a stick built conventional lavatory up in the portable office, event station or work trailer, because with the present invention installed, the lavatory can then be used by anyone, whether disabled or not. Thereby, any event trailer, work trailer or portable office can now become ADA compliant, allowing the use of the trailer in remote locations in an inexpensive and non-permanent fashion for any type of event, whether for working or for entertaining.

Referring again to FIGS. 6 and 7, within the sanitation system of FIGS. 6 and 7, a bracket 132 may be provided for removably securing objects to the walls of the sanitation system 10. The objects secured by the bracket 132 may include, but are not limited to, a toilet paper dispenser 180 and a hand soap dispenser 182. The bracket 132 as viewed from the top, is generally C-shaped, having a first arm 134, a second arm 136 and a spanning portion 138. The first arm 134 is joined to the spanning portion 138 by a first connecting member 140. The second arm 136 is joined to the spanning member 138 by a second connecting member 142. Thereby, the first and second connecting members 140, 142, serve to offset the spanning member 138 from both the first arm 134 and the second arm 136. The offset provided by the first and second connecting members 140, 142 provides space for hanging objects on the bracket 132, as described in greater detail below. The first arm 134 and the second arm 136 are preferably parallel to the spanning member 138. The first arm 134 and the second arm 136 are preferably oriented in a common plane, which plane is parallel with the spanning member 138 and which plane is perpendicular to both the first connecting member 140 and the second connecting member 142. A series of apertures are formed through the bracket 132 for accepting fasteners.

A first aperture 144 is formed through the first arm 134, the first aperture 144 is suitable for accepting a fastener which removably secures the first arm 134 to one of the walls of the sanitation system 10. A second aperture 146 is formed through the second arm 136, the second aperture 146 is suitable for accepting a fastener which removably secures the second arm 136 to one of the walls of the sanitation system 10. The spanning portion 138 includes a first access aperture 148 which provides access through the spanning portion 138 to allow a fastener to be secured at the first aperture 144. Similarly, the spanning portion 138 also includes a second access aperture 150 which provides access through the spanning portion 138 to allow a fastener to be secured at the second aperture 146. The spanning portion 138 also optionally includes one or more auxiliary apertures 152 which are spaced inwardly from the first access aperture 144 and the second access aperture 146. The auxiliary apertures 152 are suitable for securing an object, such as a toilet paper dispenser 180 or a hand soap dispenser 182, to the bracket 132.

A mating bracket 154 is provided for removably joining an object, such as a toilet paper dispenser 180, to the bracket 138. The mating bracket 154 includes a generally planar face 156 which may include one or more apertures 158, 160, 162, 164. As shown, the apertures 158, 160 are shown as elongated horizontally and are positioned on the upper half of the mating bracket 154. The apertures 162, 164 are elongate vertically and are positioned on the lower half of the mating bracket 154. The apertures 158, 160 are oriented to align with the apertures 152 on a first bracket 132, and the apertures 162, 164 are oriented to align with the apertures 152 on a second bracket 132, such that the mating bracket 154 may be joined to a pair of brackets 132 using four fasteners secured through the respective apertures. The mating bracket 154 is joined to an object, such as a toilet paper dispenser 180. One suitable mechanism for joining the mating bracket to the object is through the use of a series of tabs 166, shown in dotted line. The tabs 166 are configured to mate with slots formed on the object to allow the object to be joined to mating bracket 154, such as by aligning the tabs 166 with the slots and then sliding the object relative to the mating bracket 154 to lock the object to the mating bracket 154.

A hanging bracket 168 is provided for removably joining an object, such as a hand soap dispenser 182, to the bracket 138. The hanging bracket 168, as viewed from the side, is generally J-shaped, having a sheathing member 170 which is sized to fit in the offset defined by the first and second connecting members 140, 142. The sheathing member 170 is joined to a backing member 172 by an offset portion 174. The sheathing member 170 and the backing member 172 are preferably oriented parallel with each other with the offset portion 174 oriented perpendicularly to both the sheathing member 170 and the backing member 172. With the sheathing member 170 inserted in the offset of the bracket 132, the offset portion 174 rests on upper edge of the spanning portion 138, thereby the weight of the hanging bracket 168 is carried by the spanning portion 138. The hanging bracket 168 optionally includes one side of a hook and loop fastener 176 which is joined to the backing member 172 (the other side of the hook and loop fastener 176 being joined to the wall spaced below the bracket 132). The backing member 172 includes an outward-facing face 178 to which the object, such as a hand soap dispenser 182, is joined, such as by adhesive. The outward-facing face 178 is the side of the backing member 172 opposite the sheathing member 170.

It is understood that while certain aspects of the disclosed subject matter have been shown and described, the disclosed subject matter is not limited thereto and encompasses various other aspects. No specific limitation with respect to the specific aspects disclosed herein is intended or should be inferred. The foregoing description of preferred aspects of the invention has been presented for purposes of illustration and description. It is not intended to be exhaustive or to limit the invention to the precise form disclosed. Obvious modifications or variations are possible in light of the above teachings with regards to the specific aspects. The aspects were chosen and described in order to best illustrate the principles of the invention and its practical applications to thereby enable one of ordinary skill in the art to best utilize the invention in various aspects and with various modifications as are suited to the particular use contemplated.

What is claimed is:

1. A sanitation system having a water source and a power source, said sanitation system comprising a lavatory comprising at least a toilet and a sink with a lavatory water supply line providing water to said toilet and said sink;

a lavatory electrical system with a lavatory switch for turning said lavatory electrical system on and off; and a decontamination station comprising at least an eye wash station and a shower with a decontamination water supply line providing water to said eye wash station and to said shower;

a decontamination station electrical system with a decontamination station switch having an on position, wherein said on position provides power to said decontamination station electrical system; and a valve adapted to receive water from said water source that is actuated by turning on the decontamination station switch so that the water is switched from said lavatory water supply line to said decontamination water supply line.

2. The sanitation system of claim 1, further comprising an access/egress door which allows access to a mobile office at a level suitable for coupling to a mobile office.

3. The sanitation system of claim 1, said sanitation system further comprising a wall surrounding the lavatory with a bracket joined to said wall of said lavatory, said bracket being generally C-shaped.

4. The sanitation system of claim 3, further comprising a J-shaped bracket which couples to said bracket, and a hand soap dispenser joined to said J-shaped bracket.

5. The sanitation system of claim 3, further comprising a mating bracket which is removably coupled to a toilet paper dispenser, said mating bracket being joined by fasteners to said wall.

* * * * *